US005430529A

United States Patent [19]

Kawaguchi

[11] Patent Number: 5,430,529

[45] Date of Patent: Jul. 4, 1995

[54] DEVELOPING UNIT

[75] Inventor: Taiichi Kawaguchi, Yokohama, Japan

[73] Assignee: Kabushiki Kaisha Toshiba, Yokohama, Japan

[21] Appl. No.: 186,983

[22] Filed: Jan. 28, 1994

[30] Foreign Application Priority Data

Jan. 28, 1993 [JP] Japan ..... 5-012771

[51] Int. Cl.[6] ..... G03G 15/09

[52] U.S. Cl. ..... 355/251; 118/657; 118/658; 355/245; 355/253

[58] Field of Search ..... 355/251, 253, 215, 245; 118/656–658

[56] References Cited

U.S. PATENT DOCUMENTS

| | | | |
|---|---|---|---|
| 4,563,978 | 1/1986 | Nakamura et al. | 118/658 |
| 4,804,995 | 2/1989 | Osawa et al. | 118/657 X |
| 5,065,693 | 11/1991 | Yoshino et al. | 355/251 X |
| 5,177,536 | 1/1993 | Watanabe et al. | 355/251 |
| 5,212,525 | 5/1993 | Noami et al. | 355/251 |
| 5,267,007 | 11/1993 | Watanabe et al. | 355/245 |
| 5,287,148 | 2/1994 | Sakami et al. | 355/251 X |

FOREIGN PATENT DOCUMENTS

| | | | |
|---|---|---|---|
| 0149973 | 7/1986 | Japan | 355/251 |
| 0231472 | 9/1988 | Japan | 355/253 |
| 0275977 | 11/1990 | Japan | 355/253 |
| 0307572 | 10/1992 | Japan | 355/251 |
| 0011618 | 1/1993 | Japan | 355/253 |

*Primary Examiner*—Matthew S. Smith
*Attorney, Agent, or Firm*—Foley & Lardner

[57] ABSTRACT

A developing unit according to the present invention comprises a member interposed between adjacent first and second magnetic poles in a developer supply roller and arranged close to the second pole and to the surface of said developer supply roller, for generating a magnetic field between the second magnetic pole and the member to form a curtain of developers, peeling the developers from the surface of the developer supply roller, and separating the developers supplied by the developer supply roller and the developers peeled from the surface of the developer supply roller from the developer supply roller in the horizontal direction.

16 Claims, 4 Drawing Sheets

DEVELOPING UNIT

BACKGROUND OF THE INVENTION

1. Field of the Invention

The present invention relates to a developing unit incorporated into an image forming apparatus such as an electronic copying machine.

2. Description of the Related Art

A conventional developing unit includes a developer container for containing developers, a rotatable development roller, and a rotatable mixer. The development roller has, for example, a rotational development sleeve and a magnet having a number of magnetic poles arranged in the development sleeve in the rotating direction of the development sleeve.

The developing unit performs development as follows. First the mixer is rotated, and so is the development sleeve. In accordance with the rotation of the mixer, developers more than a suitable quantity are supplied to the surface of the development sleeve and then carried by rotation of the development sleeve. The quantity of the developers is restricted to the suitable quantity by a doctor blade during the carriage of the developers. The suitable quantity of developers are then supplied to a development position close to a photosensitive drum, thereby developing an electrostatic latent image.

In the development, not all the developers are supplied to the electrostatic latent image from the development sleeve, but some of them remain thereon. If the remaining developers are not collected in the mixer but recycled as they are, image density is lowered and image quality is degraded. In order to eliminate this problem, in the conventional developing unit, adjacent magnetic poles of the magnet, which are located on the opposite side of the development sleeve facing the photosensitive drum, are set to the same, and the developers, which have contributed to the development or passed the development position, are peeled from the development sleeve by magnetic force between the same poles and then collected in the mixer.

Since, however, the developers are not peeled sufficiently by the magnetic force between the adjacent magnetic poles, a large number of developers remain on the development sleeve. In the conventional developing unit, image quality is prevented from deteriorating by taking into consideration an angle between the adjacent magnetic poles of the magnet or a balance of the magnetic force, or by regulating the quantity of developers in the developer container to prevent the peeled developers from being attached to the development sleeve again.

It is however difficult to suitably set the angle between the adjacent magnetic poles or the balance of the magnetic force because a relationship between the magnetic poles of the magnet has to be considered.

The developing unit disclosed in Jpn. Pat. Appln. KOKAI Publication No. 2-108087 comprises a scratch member formed of a flexible member such as Mylar which contacts a development sleeve to scratch the residual developers from the development sleeve. However, the contact of the scratch member and development sleeve causes the development sleeve to be damaged and the developers to be crashed. In this conventional developing unit, the developers scratched from the development sleeve remain in the vicinity of the scratch member and are not collected efficiently in a mixer. For this reason, the developers scratched from the development sleeve are returned to the development sleeve again before the mixer, and no fresh developers can be supplied to the development sleeve.

SUMMARY OF THE INVENTION

It is accordingly an object of the present invention to provide a developing unit which is simple in construction and capable of improving in peeling the developers which have been applied to development and in conveying the peeled developers.

To attain the above object, there is provided a developing unit arranged opposite to an image bearing body for bearing a latent image, for supplying developing agent to the latent image and developing the latent image, comprising:

a developing agent supply roller arranged opposite to the image bearing body, for supplying the developing agent to the latent image by rotation thereof;

means for generating a magnetic field, arranged in the developing agent supply roller and having a plurality of magnetic poles along an inner surface of the developing agent supply roller, a first magnetic pole of the plurality of magnetic poles having a predetermined polarity and being arranged below a location where the developing agent supply roller faces the image bearing body, and a second magnetic pole of the plurality of magnetic poles having the same polarity as that of the first magnetic pole and being adjacent to the first magnetic pole in the rotating direction of the developing agent supply roller; and a member interposed between the adjacent first and second magnetic poles of the magnetic field generating means and arranged close to the second magnetic pole and to a surface of the developing agent supply roller, for generating a magnetic field to form a curtain of the developing agent between the second magnetic pole and the member, peeling the developing agent from the surface of the developing agent supply roller, and separating the developing agent supplied by the developing agent supply roller and the developing agent peeled from the surface of the developing agent supply roller in a horizontal direction from the developing agent supply roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE EMBODIMENT

An embodiment of the present invention will now be described, with reference to the accompanying drawings.

Figure 1:
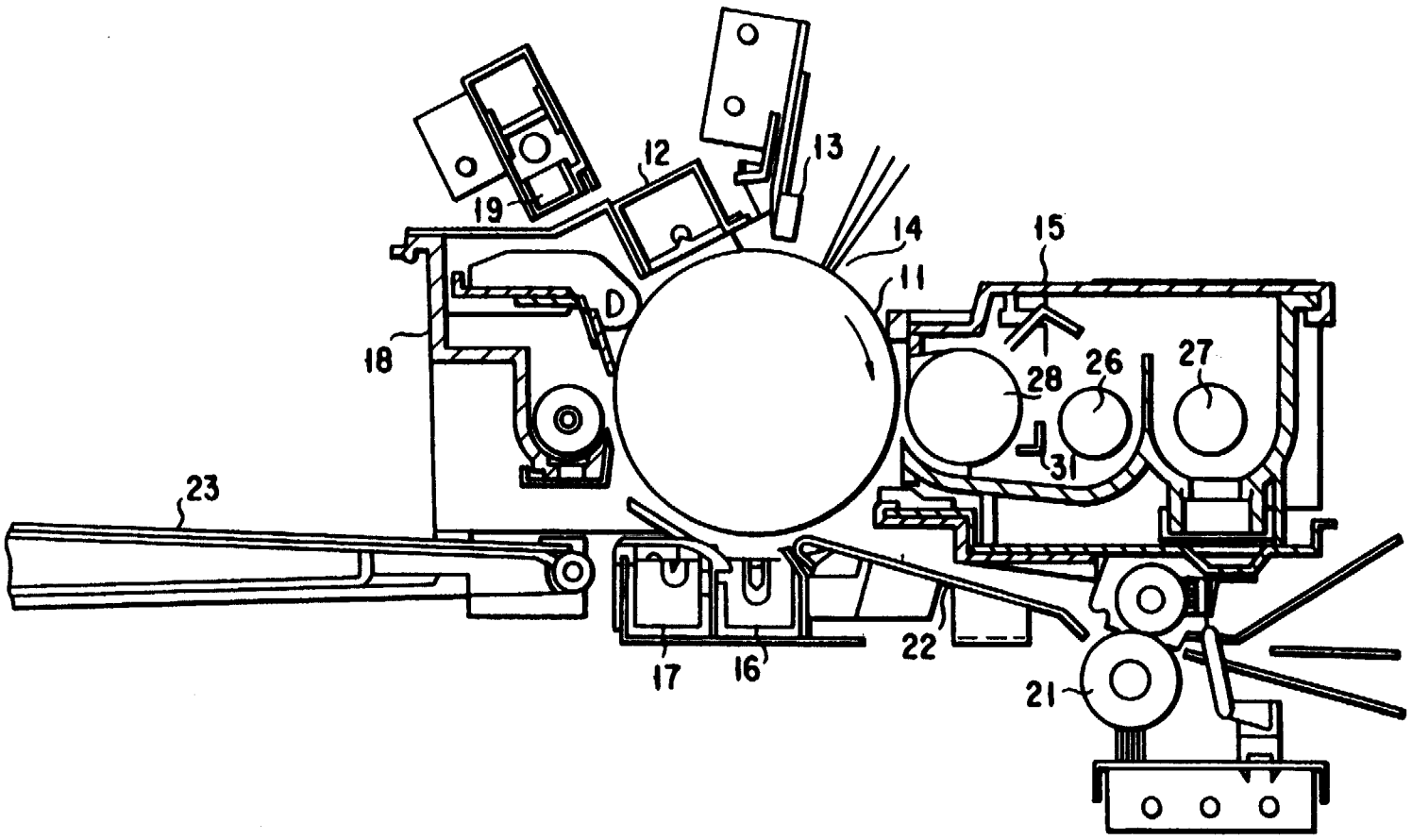
FIG. 1 is a view of a constitution of an image forming apparatus according to an embodiment of the present invention.

FIG. 1 shows the inside of an electrophotographic apparatus. In FIG. 1, reference numeral 11 indicates a photosensitive drum which can be rotated in the direction of an arrow and serves as an image bearing body. A charger 12 for uniformly charging the surface of the photosensitive drum 11, an erasure array 13 for erasing a surface potential of the photosensitive drum 11 in accordance with the width of paper, and an exposure optical path 14 for forming an electrostatic latent image, are arranged above the photosensitive drum 11. A developing unit 15 for supplying developers to visualize the latent image is provided on one side of the photosensitive drum 11, and a transfer charger 16 for transferring the visualized image to the paper and a separation charger 17 for separating the paper from the photosensitive drum 11 are arranged under the photosensitive drum 11. Furthermore, a cleaner 18 for removing developers remaining on the photosensitive drum 11 and an eliminator 19 for eliminating a potential from the surface of the photosensitive drum are provided on the other side of the photosensitive drum 11.

A pair of aligning rollers 21 for aligning paper fed from a paper feed cassette (not shown) is disposed under the developing unit 15, and a guide body 22 for guiding the paper is interposed between the pair of aligning rollers 21 and the transfer charger 16. A conveyor belt 23 for conveying the paper separated from the photosensitive drum 11 is provided on the paper feed-out side of the separation charger 17.

To form an image, the surface of the photosensitive drum 11 is charged uniformly by the charger 12, and then the surface potential of the photosensitive drum 11 is erased by the erasure array 13 in accordance with the size of the paper. After that, image information is applied to the charged portion of the photosensitive drum 11 by exposure, and an electrostatic latent image is formed. This latent image is opposed to the developing unit 15 by rotation of the photosensitive drum 11 and visualized by the developer or developing agents supplied from the developing unit 15.

At this time, paper is fed from the paper feed cassette, aligned by the aligning rollers 21, and supplied to between the photosensitive drum 11 and transfer charger 16 via the guide body 22. The visualized image is transferred to the paper by the transfer charger 16. This paper is separated from the photosensitive drum 11 by the separation charger 17 and conveyed to a fixing unit (not shown) by the conveyor belt 23. The fixing unit fixes the image to the paper, and the paper is discharged.

Figure 2:
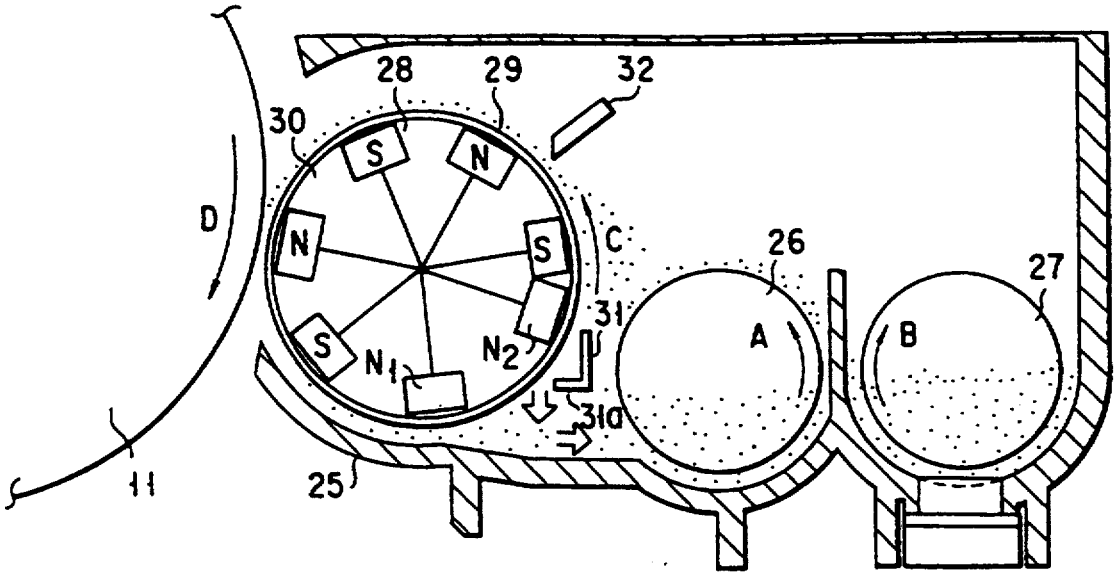
FIG. 2 is a view of a constitution of a developing unit incorporated into the image forming apparatus shown in FIG. 1.

The developing unit 15 is constructed as shown in FIG. 2.

In FIG. 2, reference numeral 25 denotes a developer container including developer and rotatable first and second mixers 26 and 27. The first mixer 26 rotates in the direction of arrow A and so does the second mixer 27 in the direction of arrow B. Thus, the developers are agitated in the developer container 25 and supplied.

The developer container 15 also includes a rotatable development roller 28 serving as a development means. The development roller 28 has a development sleeve 29 rotating in the direction of arrow C, and a magnet 30 having a number of poles is fixed in the development sleeve 29.

Paired adjacent first and second poles of the magnet 30, which are located on the opposite side of the development sleeve facing the photosensitive drum 11, are the same poles $N_1$ (800 gausses) and $N_2$ (150 to 250 gausses). After the development, the developers remaining on the development sleeve 29 are peeled by the magnetic force generated between the poles $N_1$ and $N_2$(hereinafter referred to as peeling poles $N_1$ and $N_2$). These peeling poles $N_1$ and $N_2$ are arranged below the horizontal line extending through the center CR of the development roller 28. While the peeling roller $N_1$ is located in the vicinity of the lowermost portion of the magnet 30 in the development roller 28, the peeling roller $N_2$ is located at least above the peeling roller $N_1$.

Figure 3:
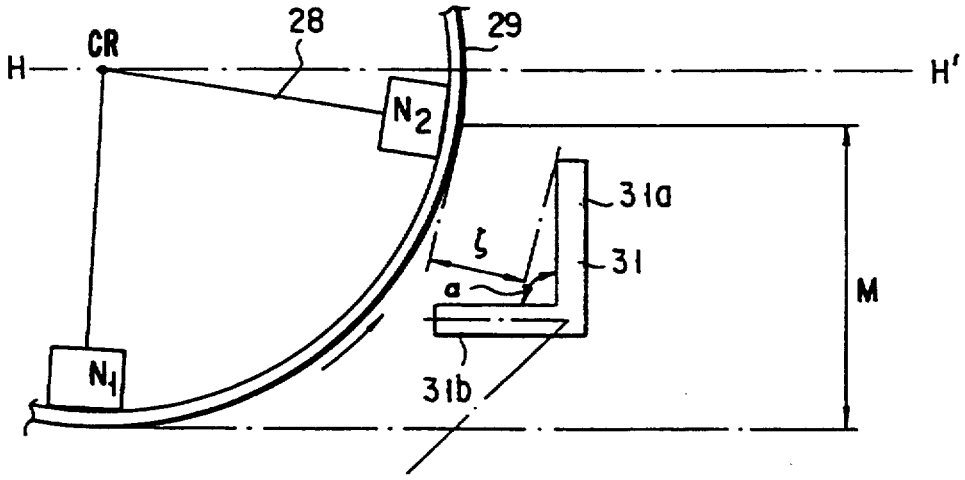
FIG. 3 is a view of the arrangement of a development roller and a peeling member of the developing unit shown in FIG. 2.

A magnetic member 31 having an L-shaped section and serving as a peeling member is formed between the development roller 28 and the first mixer 26. As shown in FIG. 3, the magnetic member 31 is located within a range of M between the peeling poles $N_1$ and $N_2$ of the magnet 30. The length of the magnetic member 31 in its longitudinal direction is equal to or more than that of the development roller 28 in its axial direction.

The magnetic member 31 includes a vertical section 31*a* and a horizontal section 31*b* which have a side in common. The magnetic member 31 is provided so that the recess of the L-shaped section is opposed to the development roller 28. The upper end of the vertical section 31*a* is located close to the peeling pole $N_2$, and a magnetic shield is formed between them by the magnetic force applied from the peeling pole $N_2$. The end of the horizontal section 31*b* is located close to substantially the middle point between the poles $N_1$ and $N_2$.

The first and second mixers 26 and 27 rotate in the directions of arrows A and B, respectively, and the development sleeve 29 rotates in the direction of arrow C. When the first and second mixers 26 and 27 rotate, developer more than a suitable quantity are supplied to the surface of the development sleeve 29. These developers are carried in the direction of arrow C and restricted to the suitable quantity by a doctor blade 32 serving as a developer quantity restricting member. Then the developers are carried to a developing position, which is close to the photosensitive drum 11, and supplied to the electrostatic latent image, thereby performing development.

Figure 4A:
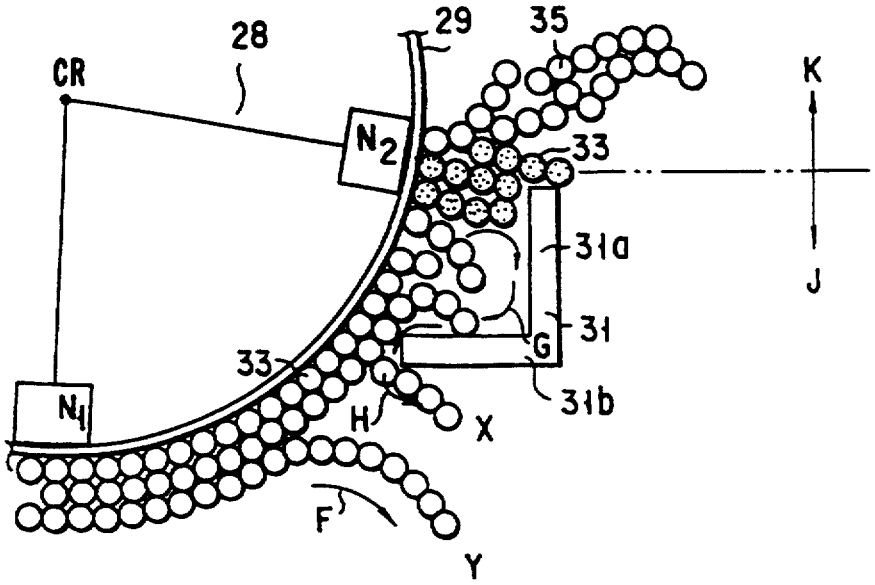
FIG. 4A is a view showing developers which are being peeled by the peeling member of FIG. 3.

After the development, as shown in FIG. 4A, developers remaining on the development sleeve 29 are normally peeled in the direction of arrow F by the magnetic force generated between the peeling poles $N_1$and $N_2$ of the development roller 28. Further, developers 33 which were not peeled but remain on the development sleeve 29, are carried toward the peeling pole $N_2$. These developers 33 are stopped (as indicated by black dots) by the magnetic shield formed between the upper end of the vertical section 31*a* of the magnetic member 31 and its opposite peeling pole $N_2$, thereby forming a shield curtain of the developers 33. The subsequent developers 33 collide with the shield curtain, and are reversed and peeled from the development sleeve 29. The peeled developers 33 are carried along the inner surface of the vertical section 31*a* of the magnetic member 31 and the upper surface of the horizontal section 31*b* thereof and then sent downward from the end of the horizontal section 31*b*, as indicated by arrows G and H in FIG. 4A.

In FIG. 4A, white dots on the J side represent developers 33 which have been applied to development, and those on the K side represent developers 33 which are newly supplied.

Figure 4B:
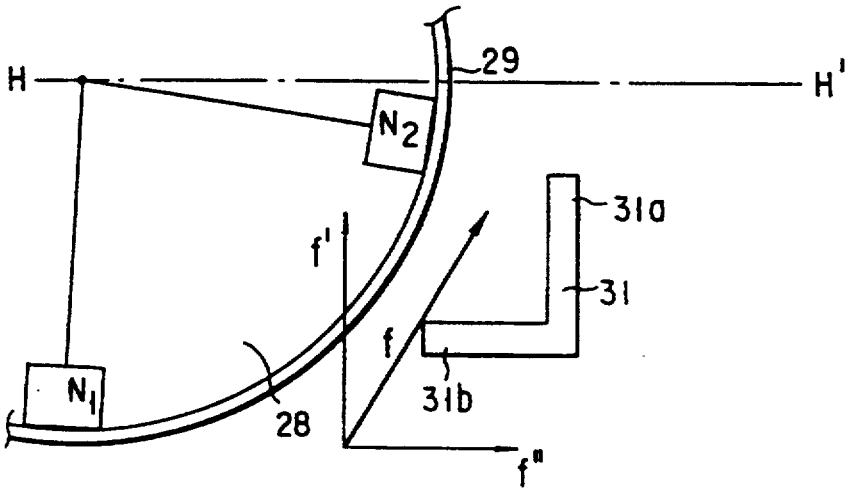
FIG. 4B is a view for explaining the force exerted on the peeled developers.

As shown in FIG. 4B, the developers 33 peeled by the magnetic force generated between the peeling poles $N_1$ and $N_2$, and the developers 33 peeled by the shield curtain and supplied below the magnetic member 31, are pushed upward along the circumference of the development sleeve 29 by the force f generated by the rotation of the development sleeve 29. This force f is divided into force f' in the gravity direction and force f'' in the horizontal direction. The force f by which the developers are moving upward along the circumference of the development sleeve, is equal to only the force f'' at the horizontal section 31*b* of the magnetic member 31 since the force f' is controlled by the horizontal section 31*b*. Then the developers 33 are conveyed toward the first mixer 26 by the force f''.

Consequently, the developers are efficiently exchanged between the development roller 28 and the mixer 26 and, more specifically, the developers peeled from the development roller 28 are exchanged satisfactorily for new developers, without stagnating between the development roller 28 and mixer 26. No white spots are formed in images by introducing the developers into solid images, or neither image density is lowered nor development irregularities occur when the density of the developers on the development roller 28 is lowered. It is thus possible to form a stable image at any time.

As shown in FIG. 3, an angle a between the vertical section 31*a* and horizontal section 31*b* of the magnetic member 31 has to fall within a range from 90° to 135° ($90° \leqq \alpha \leqq 135°$). When angle $\alpha$ is smaller than 90°, the developers 33 shown in FIG. 4A are collected on the inner side of the magnetic member 31 and pushed up toward the developer quantity restricting member 32, thereby lessening the peeling effect. In contrast, when angle $\alpha$ exceeds 135°, the developers 33 are blocked to be prevented from smoothly flowing into the developer container 21. Thus, there is fear that extra developers will flow outside the developer container 21. Furthermore, the above-described force f'' by which the developers are conveyed toward the first mixer 26, is reduced, and the efficiency in exchange of the peeled developers is lowered.

The effect of gap $\zeta$ between the development roller 28 and the upper end of the magnetic member 31, shown in FIG. 3, will now be described.

Figure 5:
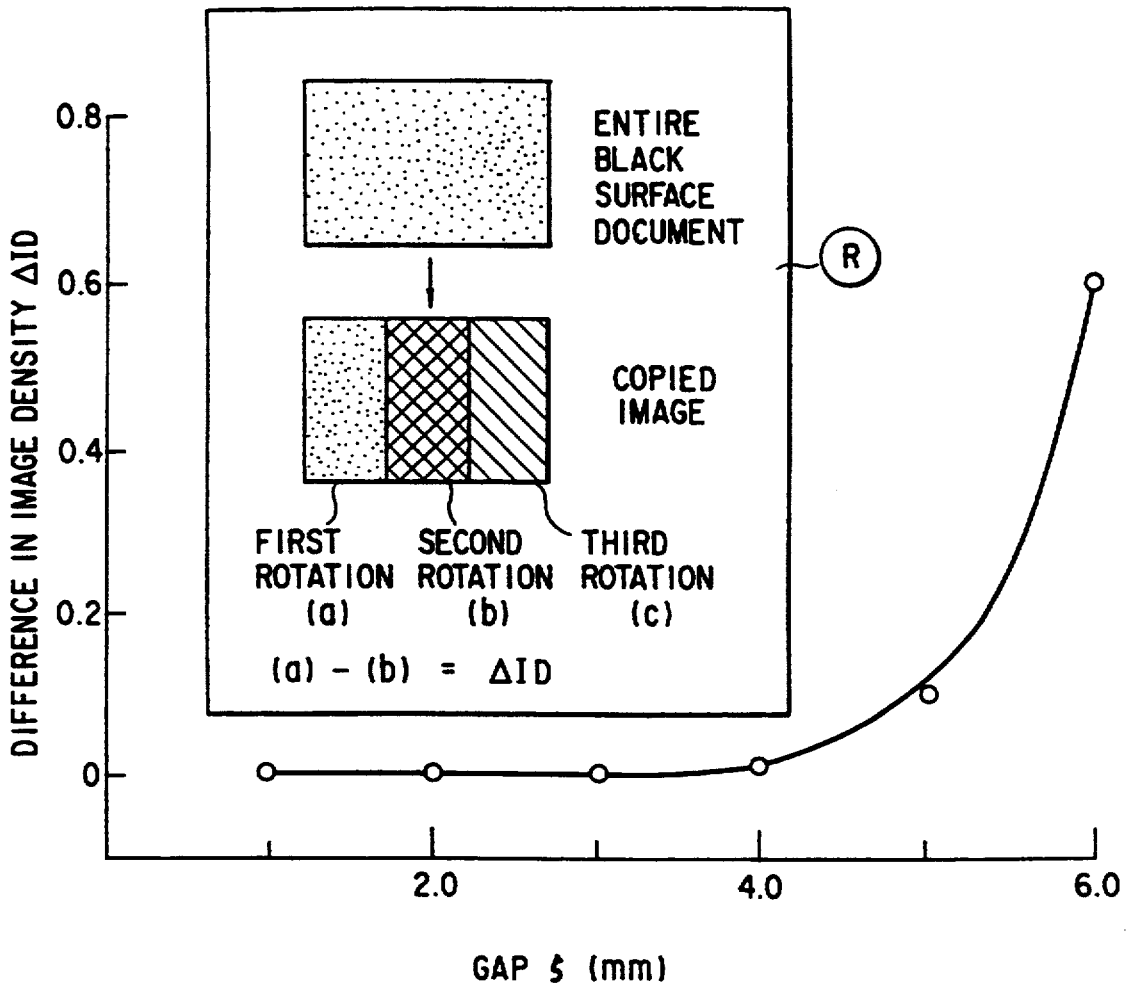
FIG. 5 is a graph showing a relationship between image density and gap between the development roller and peeling member of the developing unit of FIG. 2.

FIG. 5 is a graph showing a relationship between gap $\zeta$ and difference $\Delta$ID in image density between a copying operation and its subsequent copying operation.

As is apparent from FIG. 5, when the gap $\zeta$ between the upper end of the vertical section 31*a* of the magnetic member 31 and its opposite peeling pole $N_2$exceeds 4 mm, the magnetic effect between them is decreased; accordingly, the efficiency in collecting the developers from the development sleeve 29 is reduced, and the developers, which have been used for development many times, remain on the development sleeve 29. As a result, the developers gradually become difficult to attach to the development sleeve 29 whenever a copying operation is repeated, and the difference $\Delta$ID is increased. If the difference $\Delta$ID is increased, density irregularities will occur even in one copied image, as indicated by "R" in FIG. 5, and the quality of the image greatly deteriorates. In other words, the gap $\zeta$ has to be less than 4 mm.

In the above embodiment, the L-shaped member has been described as magnetic member 31 formed of magnetic material. However, the same effect can be obtained if at least the vertical section 31*a* of the magnetic member is formed of magnetic material and, in other words, the vertical section can be formed of magnetic material and the horizontal section can be formed of non-magnetic material.

According to the above-described embodiment of the present invention, the use of the magnetic shield effect of the peeling pole $N_2$ opposed to the upper end of the vertical section 31*a* of the magnetic member 31 improves the peeling performance of developers and the image quality, without bringing them into contact with each other.

The present invention can be applied to a magnetic monocomponent development method using a development roller having a structure in which a magnet is fixed inside the development roller and to its similar magnetic method as well as a two-component development method.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A developing unit arranged opposite to an image bearing body for bearing a latent image, for supplying developing agent to the latent image and developing the latent image, comprising:

a developing agent supply roller arranged opposite to said image bearing body, for supplying the developing agent to said latent image by rotation thereof;

a first generating means for generating a magnetic field, arranged in said developing agent supply roller and having a plurality of magnetic poles along an inner surface of said developing agent supply roller, a first magnetic pole of said plurality of magnetic poles having a predetermined polarity and being arranged below a location where said developing agent supply roller faces said image bearing body, and a second magnetic pole of said plurality of magnetic poles having the same polarity as that of said first magnetic pole and being adjacent to said first magnetic pole in the rotating direction of said developing agent supply roller;

a second generating means located opposite to said second magnetic pole, for generating a magnetic field to form a curtain of the developing agent between said second magnetic pole and said second generating means, thereby peeling the developing agent from the surface of said developing agent supply roller; and means interposed between said adjacent first and second magnetic poles, for guiding the developing agent peeled from the surface of said developing agent supply roller toward an inside of said developing unit.

2. The developing unit according to claim 1, wherein a length of said member in a longitudinal direction is equal to or more than a length of said developing agent supply roller in an axial direction thereof.

3. The developing unit according to claim 1, wherein said member converts a force by which the developing agent are moved in an antigravity direction by said developing agent supply roller into a force in a horizontal direction.

4. A developing unit arranged opposite to an image bearing body for bearing a latent image, for supplying developing agent to the latent image and developing the latent image, comprising:

a developing agent supply roller arranged opposite to said image bearing body for supplying the developing agent to said latent image by rotation thereof;

means for generating a magnetic field, arranged in said developing agent supply roller and having a plurality of magnetic poles along an inner surface of said developing agent supply roller, a first magnetic pole of said plurality of magnetic poles having a predetermined polarity and being arranged below a location where said developing agent supply roller faces said image bearing body, and a second magnetic pole of said plurality of magnetic poles having the same polarity as that of said first magnetic pole and being adjacent to said first magnetic pole in the rotating direction of said developing agent supply roller; and a member interposed between said adjacent first and second magnetic poles of said magnetic field generating means and arranged close to said second magnetic pole and to a surface of said developing agent supply roller, for generating a magnetic field to form a curtain of the developing agent between said second magnetic pole and said member, peeling the developing agent from the surface of said developing agent supply roller, and separating the developing agent supplied by said developing agent supply roller and the developing agent peeled from the surface of said developing agent supply roller in a horizontal direction from said developing agent supply roller;

wherein said first and second magnetic poles are arranged below a horizontal line extending through a center of said developing agent supply roller, said first magnetic pole is arranged close to a lowermost portion of said developing agent supply roller, and said second magnetic pole is arranged at least above said first magnetic pole.

5. A developing unit arranged opposite to an image bearing body for bearing a latent image, for supplying developing agent to the latent image and developing the latent image, comprising:

a developing agent supply roller arranged opposite to said image bearing body, for supplying the developing agent to said latent image by rotation thereof;

means for generating a magnetic field, arranged in said developing agent supply roller and having a plurality of magnetic poles along an inner surface of said developing agent supply roller, a first magnetic pole of said plurality of magnetic poles having a predetermined polarity and being arranged below a location where said developing agent supply roller faces said image bearing body, and a second magnetic pole of said plurality of magnetic poles having the same polarity as that of said first magnetic pole and being arranged adjacent to said first magnetic pole in the rotating direction of said developing agent supply roller;

a first member arranged close to the second pole of said magnetic field generating means and to a surface of said developing agent supply roller and having a length corresponding to a length of said developing agent supply roller in an axial direction thereof, for generating a magnetic field to form a curtain of the developing agent between said second magnetic pole and said first member, and peeling the developing agent from the surface of said developing agent supply roller; and a second member arranged below said first member and close to the surface of said developing agent supply roller between the first and second poles of said magnetic field generating means, having a length corresponding to the length of said developing agent supply roller, and also having a section in a lateral direction thereof which is almost perpendicular to a gravity direction, for controlling the developing agent moved in an antigravity direction by the rotation of said developing agent supply roller and separating the developing agent from said developing agent supply roller in a horizontal direction.

6. The developing unit according to claim 5, wherein said first and second magnetic poles are arranged below a horizontal line extending through a center of said developing agent supply roller, said first magnetic pole is arranged close to a lowermost portion of said developing agent supply roller, and said second magnetic pole is arranged at least above said first magnetic pole.

7. The developing unit according to claim 5, wherein a length of said first and second member in a longitudinal direction thereof is equal to or more than the length of said developing agent supply roller in the axial direction thereof.

8. The developing unit according to claim 5, wherein said first member converts a force by which the developing agent are moved in the antigravity direction by said developing agent supply roller into a force in the horizontal direction.

9. A developing unit arranged opposite to an image bearing body for bearing a latent image, for supplying developing agent to the latent image and developing the latent image, comprising:

a developing agent supply roller arranged opposite to said image bearing body, for supplying the developing agent to said latent image by rotation thereof;

means for generating a magnetic field, arranged in said developing agent supply roller and having a plurality of magnetic poles along an inner surface of said developing agent supply roller, a first magnetic pole of said plurality of magnetic poles having a predetermined polarity and being arranged below a location where said developing agent supply roller faces said image bearing body, and a second magnetic pole of said plurality of magnetic poles having the same polarity as that of said first magnetic pole and being arranged adjacent to said first magnetic pole in the rotating direction of said developing agent supply roller; and means for eliminating developing agent, including a magnetic member having a first plane having first and second sides in a longitudinal direction thereof and a second plane having third and fourth sides in the longitudinal direction thereof, said first and second planes being connected to each other so that said second side corresponds to the third side, said first side being close to a surface of said developing agent supply roller and the second magnetic pole, said second and third sides being away from the surface of said developing agent supply roller, and said fourth side being close to the surface of said developing agent supply roller and between said first and second magnetic poles, said developing agent eliminating means forming a magnetic curtain between said second magnetic pole and said developing agent eliminating means, thereby eliminating the developing agent from said developing agent supply roller and controlling movement of the eliminated developing agent.

10. The developing unit according to claim 9, wherein said first and second magnetic poles are arranged below a horizontal line extending through a center of said developing agent supply roller, said first magnetic pole is arranged close to a lowermost portion of said developing agent supply roller, and said second magnetic pole is arranged at least above said first magnetic pole.

11. The developing unit according to claim 9, wherein a length of said member in a longitudinal direction is equal to or more than a length of said developing agent supply roller in an axial direction thereof.

12. The developing unit according to claim 9, wherein said developing agent eliminating means converts a force by which the developing agent are moved in an antigravity direction by said developing agent supply roller into a force in a horizontal direction.

13. A developing unit arranged opposite to an image bearing body for bearing a latent image, for supplying developing agent to the latent image and developing the latent image, comprising:

a developing agent supply roller arranged opposite to said image bearing body, for supplying the developing agent to said latent image by rotation thereof;

means for generating a magnetic field, arranged in said developing agent supply roller and having a plurality of magnetic poles along an inner surface of said developing agent supply roller, a first magnetic pole of said plurality of magnetic poles having a predetermined polarity and being arranged below a location where said developing agent supply roller faces said image bearing body, and a second magnetic pole of said plurality of magnetic poles having the same polarity as that of said first magnetic pole and being arranged adjacent to said first magnetic pole in the rotating direction of said developing agent supply roller; and a magnetic member having an L-shaped section in a lateral direction thereof, one end portion of said magnetic member in a longitudinal direction being close to the second magnetic pole of said magnetic field generating means and to a surface of said developing agent supply roller, and another end portion of said magnetic member in the longitudinal direction being close to the surface of said developing agent supply roller between the first and second magnetic poles of said magnetic field generating means.

14. The developing unit according to claim 13, wherein said first and second magnetic poles are arranged below a horizontal line extending through a center of said developing agent supply roller, said first magnetic pole is arranged close to a lowermost portion of said developing agent supply roller, and said second magnetic pole is arranged at least above said first magnetic pole.

15. The developing unit according to claim 13, wherein a length of said member in a longitudinal direction is equal to or more than a length of said developing agent supply roller in an axial direction thereof.

16. The developing unit according to claim 13, wherein said magnetic member converts a force by which the developing agent are moved in an antigravity direction by said developing agent supply roller into a force in a horizontal direction.

* * * * *